United States Patent [19]

Mangrum

[11] 4,002,131

[45] Jan. 11, 1977

[54] BOAT HULL CONSTRUCTION

[76] Inventor: Lee R. Mangrum, Rte. 1, Box 98, Lincoln, Tex. 78948

[22] Filed: Apr. 16, 1976

[21] Appl. No.: 677,518

[52] U.S. Cl. ..... 114/56; 9/1.1; 9/5; 114/63

[51] Int. Cl.[2] ..... B63B 1/04

[58] Field of Search ..... 114/56, 63, 66.5 R, 114/66.5 S; 9/1.1, 5, 6 R, 6 M, 6 P, 6 W, 11 R, 310 B, 310 E

[56] References Cited

UNITED STATES PATENTS

| | | | |
|---|---|---|---|
| 1,729,446 | 9/1929 | Maier | 114/56 |
| 2,741,207 | 4/1956 | Leone | 114/56 |
| 3,295,152 | 1/1967 | Shelley | 9/6 W |
| 3,495,563 | 2/1970 | Reischmann | 114/66.5 R |

*Primary Examiner*—Trygve M. Blix
*Assistant Examiner*—Stuart M. Goldstein

[57] ABSTRACT

The hull of a generally shallow draft boat comprises a bottom, sides joined to the bottom by chine portions having rounded outer surfaces, and a transom adjoining the stern edges of the bottom and sides. The bottom includes first and second laterally opposite wings, the lower surfaces of which taper downwardly and laterally inwardly from their respective side edges and converge in a shallow first peak which extends partially along the longitudinal centerline of the bottom and whose rear end is disposed forwardly of the stern edge of the bottom. A pair of longitudinally extending keelsons depend downwardly from the bottom on opposite sides of the centerline of the bottom and equally spaced therefrom. A generally triangular delta formation on the bottom has a base disposed adjacent the transom and an apex disposed adjacent the rear end of the first peak and between the keelsons. The lower surface of the delta formation tapers downwardly and laterally inwardly from the respective side edges of the delta formation to form a second peak extending along the centerline of the bottom from the transom to the rear end of the first peak. The second peak is inclined upwardly from the transom to the rear end of the first peak.

15 Claims, 5 Drawing Figures

BOAT HULL CONSTRUCTION

BACKGROUND OF THE INVENTION

1. Field of the Invention

The present invention pertains to boat hull construction and particularly to shallow draft boats such as scooters. A scooter is typically a relatively small, generally flat-bottomed boat. Scooters and like boats may be used in extremely shallow water and are commonly used by sport fishermen to enter excellent but inaccessable fishing areas such as back bays and mud flat areas.

The very first scooters were quite primitive, somewhat resembling small box-like sleds in shape, and were caused to float by attachment of various makeshift buoyant bodies such as life jackets, cans, etc. These early scooters were motor driven. They were usually made of wood and were steered simply by the passenger leaning to one side or the other.

2. Description of the Prior Art

As improved materials such as fiberglass have become more readily available, scooters have become larger and more sophisticated. However, they still retain the box-like sled type configuration which allows them to be used in extremely shallow waters but which also makes them difficult to control and uncomfortable to ride. Conventional scooters are flat-bottomed with blunt bow sections. Their sides are disposed at about 90° to their bottoms and meet in a relatively sharp angle at the chines. The bottoms generally lack keels, or other depending structures.

One of the major disadvantages with such conventional scooters is the lack of control when turning. The boat tends to slide sideways in a turn, due to its flat bottom, and/or will stop dead, throwing objects off the deck. The relatively sharp chines and substantially perpendicular sides and bottom make the boat tend to hang into a wave when turning and cause "trip" or a bouncing effect. The blunt bow section makes the boat rough and wet riding.

Any attempts to eliminate these problems by using conventional keels, centerboards, curved bottoms, etc. such as are found on deeper draft boats, would make the scooter valueless for its primary purpose, i.e. use in extremely shallow waters.

SUMMARY OF THE INVENTION

The present invention comprises a hull for a shallow draft boat which makes the boat easier to handle and more comfortable to ride without sacrificing the ability of the boat to navigate extremely shallow waters. The bottom of the hull of the invention includes first and second laterally opposite wings. The lower surfaces of the wings taper slightly downwardly and laterally inwardly from their side edges and converge in a shallow first peak extending at least partially along the longitudinal centerline of the bottom. The lower surfaces of the wings are substantially straight in transverse cross section so that the peak is achieved without any significant rounding of the lower surface of the hull bottom, as in deep draft boats having keels. Consequently, the peak is not disposed lower than the side edges of the wings by more than a few inches. Yet the peak will help to prevent sideways sliding of the boat in a turn. The first peak also helps to make the boat bank when turning, to eliminate trip, and to make the ride smoother and more comfortable.

The angle formed at the first peak is preferably substantially constant from the rear end of the peak to a transverse line spaced from the bow by a distance approximately equal to one-third of the length of the hull. From this line forward, the angle at the peak increases to 180° near the bow, and the hull bottom is curved longitudinally upwardly. The curvature of the forward portion of the hull bottom allows the hull to glide over oncoming waves at high speeds and to lift over the waves at low speeds making the ride in either case dryer and more comfortable. The continuation of the peak into the curved forward portion of the hull bottom prevents the bow from acting as a plow against the water, thereby increasing the boat's efficiency, and also helps to make the ride smoother.

In the preferred embodiments, the sides of the hull are not substantially perpendicular to the bottom but rather taper inwardly from their upper edges or gunwales to the respective chines. The chines in turn are rounded rather than sharp, and these two features together help to prevent the boat from tripping or hanging up when turning.

The hull also includes a pair of longitudinally extending keelsons depending downwardly from the bottom and equally spaced on opposite sides of the longitudinal centerline. The keelsons do not extend down far enough to interfere with the ability of the boat to navigate very shallow waters, yet they do cooperate with the first peak in preventing sideways sliding and allowing the boat to bank when turning. The outer side surfaces of the keelsons are preferably disposed at obtuse angles with respect to horizontal (when the boat is in a static position) to provide extra lift on the side of the hull that is going into a turn. The inner side surfaces of the keelsons are roughly perpendicular to horizontal to enhance the prevention of sideways sliding.

A delta formation is disposed on the hull bottom. The delta formation has a base disposed adjacent the transom and an apex disposed adjacent the rear end of the first peak and between the keelsons. The side edges of the delta formation converge from the lateral extremities of the base to the apex, and the lower surface of the delta formation tapers downwardly and laterally inwardly from its respective side edges to form a second peak extending along the longitudinal centerline of the bottom from the transom to the rear end of the first peak. The second peak is shallow although somewhat steeper than the first. The second peak is also inclined upwardly from the transom to the rear end of the first peak.

The delta formation imparts added lift to the hull at the start of forward motion, this lift diminishing as the speed increases. The delta formation also counteracts the air lift given to the hull by the curvature of the forward portion of the bottom. When the delta formation is provided along with keelsons as described above, water is trapped between the keelsons. Then during forward motion, this water is forced to flow rearwardly between the keelsons and over the delta. This tends to lift the stern of the boat allowing it to ride in a more level position and high on the water. It also provides for a smoother ride due to a cushioning effect.

Together the above features, as well as others to be described more fully below, cooperate to enhance the comfort and maneuverability of the boat without substantially increasing its draft.

It is thus a principal object of the invention to provide an improved hull for a shallow draft boat.

Another object of the invention is to provide a shallow draft boat hull which allows greater control particularly during turning.

Still another object of the invention is to provide a hull for a shallow draft boat which allows a relatively smooth, dry and comfortable ride.

A further object of the invention is to provide the above advantages in a boat without substantially diminishing the ability of the boat to navigate extremely shallow waters.

Still other objects, features, and advantages of the present invention will be made apparent by the following description of the preferred embodiments, the drawings and the claims.

DESCRIPTION OF THE PREFERRED EMBODIMENTS

Figure 1:
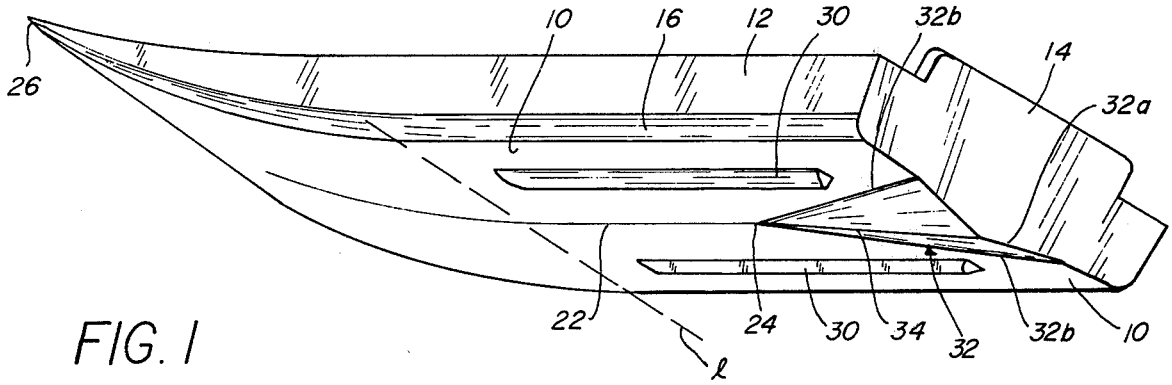
FIG. 1 is a perspective view of a boat hull in accord with the present invention.

Referring now to the drawings, there is shown a hull for a shallow draft boat including a bottom comprised of laterally opposite wings 10, opposite sides 12, and a transom 14. The lower edges of the sides 12 are joined to respective ones of the side edges of the bottom on chine portions 16. A deck 18 joins the upper edges or gunwales of the sides 12 to each other.

Figure 3:
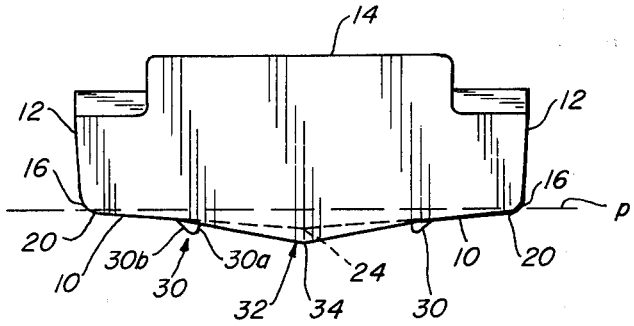
FIG. 3 is a rear elevational view of the hull of FIGS. 1 and 2.
Figure 4:
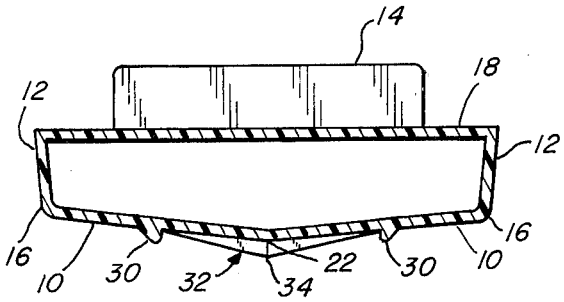
FIG. 4 is a transverse sectional view taken on lines 4—4 of FIG. 2.
Figure 5:
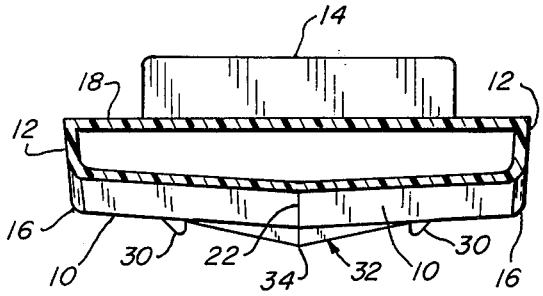
FIG. 5 is a transverse sectional view taken on lines 5—5 of FIG. 2.

As best seen in FIGS. 3–5, the lower surfaces of the wings 10 taper slightly downwardly and laterally inwardly from their respective side edges 20 and converge in a shallow peak 22 at the longitudinal centerline of the bottom. The angle formed at peak 22 remains constant from the rear end 24 of the peak to a transverse line 1 spaced from the bow 26 of the hull by a distance approximately one-third the total length of the hull. Forwardly of line 1, the angle at peak 22 increases to 180° adjacent the bow 26. The difference between the angle at peak 22 rearwardly of line 1 and at a point between line 1 and bow 26 can be seen by comparison of FIGS. 4 and 5.

Figure 2:
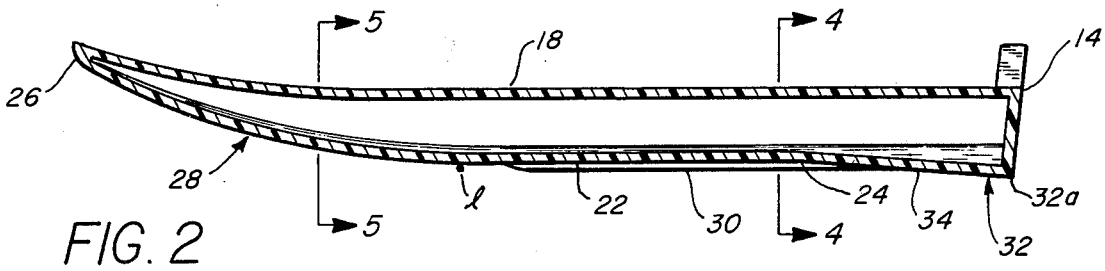
FIG. 2 is a longitudinal sectional view of the hull of FIG. 1.

The bottom of the hull also tapers upwardly in the longitudinal (as opposed to transverse) direction, i.e. in longitudinal cross section, from line 1 to bow 26 through a shallow curve as best shown at 28 in FIG. 2.

The lower surfaces of wings 10 are substantially straight in transverse cross section, as shown in FIGS. 3–5, over substantially the entire length of the hull. As shown in FIG. 3, the rear end 24 of peak 22 is spaced from a plane p through the rear portions of the side edges 20 of the lower surface of the bottom by only a small distance. In a boat of typical size and design, e.g. 16 to 20 feet in length by 6 to 8 feet in width, this distance is preferably between ½ inch and 3 inches. Thus the provision of the peak 22 does not increase the depth of the boat to the extent that it would interfere with its ability to navigate the extremely shallow waters in which scooter type boats are typically used.

The peak 22, although shallow, helps to prevent sideways sliding of the boat in a turn. Additionally the peak 22 tends to make the boat bank when turning, to eliminate trip, and to cause the boat to ride more smoothly and comfortably.

The curvature 28 allows the hull to glide over oncoming waves when the boat is traveling at high speeds and to lift over the waves at lower speeds. This cooperates with the peak 22 and other features to be described below in making the boat ride dryer and more comfortably. The continuation of peak 22 into curved portion 28 helps to prevent the bow of the boat from "plowing" the water, and this too enhances the comfort of the ride while also increasing the efficiency of the boat.

Referring again to FIGS. 3–5, it can be seen that the outer surfaces of the sides 12 taper slightly laterally inwardly from their respective gunwales or upper edges of the respective chines 16. The outer surfaces of the chines in turn are rounded in transverse cross section. For a hull of the typical dimensions given above, the radius of curvature of the chines is preferably between 1 inch and 3 inches depending on the other design features of the boat. The tapering of the sides 12 and the rounded configuration of the chines 16 together act to inhibit the boat from tripping or hanging up when turning.

A pair of keelsons 30 and a delta formation 32 are disposed on the bottom of the hull. None of these structures depend downwardly sufficiently to prevent the boat from navigating shallow water. In particular, the lowermost extremity of each of these structures would not extend beyond the peak 22 by more than about three inches. The keelsons 30 are disposed on opposite sides of the longitudinal centerline of the bottom of the hull, equally spaced from and parallel to the centerline. The inner surface 30*a* of each keelson is disposed at an angle of 85° to 95° with respect to horizontal, e.g. with respect to plane *p*. The outer surface 30*b* is disposed at an obtuse angle, preferably between 120° and 150°, with respect to horizontal. An angle of 135° with respect to horizontal is especially desirable for the outer surface 30*b*. The lower surfaces of the keelsons are rounded.

The length of the keelsons 30 is approximately two-thirds the wetted length of the bottom of the hull in use at an average speed, and the lateral spacing between the keelsons is approximately two-thirds the width of the bottom of the hull. The rear ends of the keelsons 30 terminate forwardly of the of the transom 14, in particular about halfway along the length of the delta formation 32.

The keelsons 30, especially their inner side surfaces, cooperate with the peak 22 in preventing sideways sliding of the boat and facilitating banking when turning. The obtuse angle of the outer surfaces 30*b* with respect to horizontal provides extra lift on the side of the hull that is going into a turn.

The delta formation 32 is a generally equilatural triangular structure. It has a base 32*a* extending generally across the central portion of the transom 14 and opposite side edges 32*b* disposed contiguous the hull bottom which converge from the extremities of the base to an apex located at the rear end 24 of peak 22. The width of base 32*a* is approximately one half the width of the hull bottom. The lower surface of the delta formation 32 tapers downwardly and laterally inwardly from the side edges 32*b* to form a second peak 34 extending along the longitudinal centerline of the hull bottom from the rear end 24 of peak 22 to the transom 14. Peak 34 is also inclined upwardly from the transom 14 to point 24 as shown in FIG. 2. Peak 34 is shallow although somewhat more acute than peak 22.

At the start of forward motion, the delta formation 32 imparts added lift to the hull. This lift decreases as the speed increases. The delta formation also counteracts the air lift given to the hull by the curvature 28 of the hull bottom adjacent the bow 26. Additionally, the delta formation 32 cooperates with the keelsons 30 to further enhance the quality of the ride of the boat. In particular, during forward motion, water is trapped between the keelsons 30 and forced to flow rearwardly therebetween and over the delta formation 32. This tends to lift the stern of the boat so that it rides in a more level position and high on the water. The water flowing as described above also provides a cushioning effect which makes for a smoother ride.

As can be seen from the above description, the hull of the present invention makes possible a shallow draft boat which, without sacrificing navigability in shallow water, is much easier to control, especially in turns, and more comfortable to ride than conventional scooters. It will be appreciated that many modifications may be made in the preferred embodiment described above without departing from the spirit of the invention. In particular, less preferable embodiments might include some of the features of the above hull but not others. Accordingly, it is intended that the scope of the invention be limited only by the claims which follow.

I claim:

1. A boat hull comprising:

a bottom including first and second laterally opposite wings, the lower surfaces of said wings tapering downwardly and laterally inwardly from respective side edges thereof and converging in a shallow first peak extending partially along the longitudinal centerline of said bottom, said first peak having a rear end disposed forwardly of the stern edge of said bottom;

first and second sides disposed adjacent respective ones of the side edges of said bottom and extending generally upwardly;

first and second chine portions joining respective ones of said sides to the adjacent side edge of said bottom, said chine portions having outer surfaces curved in transverse cross section;

a transom adjoining the stern edges of said bottom and said sides and extending generally upwardly;

a pair of longitudinally extending keelsons depending downwardly from said bottom, disposed on opposite sides of the longitudinal centerline of said bottom and equally spaced therefrom;

a generally triangular delta formation on said bottom, said delta formation having a base disposed adjacent said transom, an apex disposed adjacent the rear end of said first peak and between said keelsons, and side edges converging from the lateral extremities of said base to said apex, the lower surface of said delta formation tapering downwardly and laterally inwardly from the respective side edges of said delta formation to form a second peak extending along the longitudinal centerline of said bottom from said transom to the rear end of said first peak, and said second peak being inclined upwardly from said transom to the rear end of said first peak.

2. A hull according to claim 1, wherein the lower surface of each of said wings is substantially straight in transverse cross section.

3. A hull according to claim 2 wherein the angle formed at said first peak is substantially constant from the rear end of said peak to a transverse line spaced from the bow of said hull by a distance approximately equal to onejshird of the length of said hull.

4. A hull according to claim 3 wherein the rear end of said peak is spaced from a transverse plane through the rear portion of the side edges of the lower surface of said bottom by a distance between ½ inch and 3 inches.

5. A hull according to claim 3 wherein the lower surface of said bottom curves upwardly in a longitudinal direction from said transverse line to the bow of said hull, and wherein the angle formed at said first peak gradually increases from said transverse line forwardly to an angle of 180° adjacent the bow of said hull.

6. A hull according to claim 2 wherein the radius of curvature of said outer surfaces of said chine portions is between 1 inch and 3 inches.

7. A hull according to claim 2 wherein said sides taper inwardly from their upper edges to the respective ones of said chine portions.

8. A hull according to claim 1 wherein said keelsons are approximately parallel.

9. A hull according to claim 8 wherein each of said keelsons has an outer side surface disposed at an angle of 120° to 150° with respect to horizontal.

10. A hull according to claim 9 wherein each of said keelsons has an inner side surface disposed at an angle of 85° to 95° with respect to horizontal.

11. A hull according to claim 8 wherein the length of said keelsons is approximately equal to two-thirds of the wetted length of said bottom, and wherein the rear ends of said keelsons are disposed forwardly of said transom.

12. A hull according to claim 11 wherein said keelsons are laterally spaced apart by a distance approximately equal to two-thirds of the width of said bottom.

13. A hull according to claim 1 wherein the rear end of said second peak is lower than the rear end of said first peak by a distance no greater than 3 inches.

14. A hull according to claim 1 wherein the length of said side edges of said delta formation is approximately equal to the width of said base.

15. A hull according to claim 14 wherein the width of said base is approximately equal to one half of the width of said bottom, wherein the rear ends of said keelsons are spaced from said transom by a distance approximately equal to half the length of said delta formation, and wherein said keelsons are laterally spaced from each other by a distance approximately equal to two-thirds of the width of said bottom.

* * * * *

UNITED STATES PATENT OFFICE

CERTIFICATE OF CORRECTION

Patent No. 4,002,131 Dated January 11, 1977

Inventor(s) Lee R. Mangrum

It is certified that error appears in the above-identified patent and that said Letters Patent are hereby corrected as shown below:

In Column 6, line 13, delete "onejshird" and insert therefor --one-third--.

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*